United States Patent [19]

Mitchell

[11] Patent Number: 4,490,198

[45] Date of Patent: Dec. 25, 1984

[54] METHOD OF HANGING WALLPAPER

[75] Inventor: Larry L. Mitchell, Athens, Ala.

[73] Assignees: Jimmy R. Bobo; Wilbur P. Fowler, both of Arab, Ala.

[21] Appl. No.: 449,536

[22] Filed: Dec. 13, 1982

[51] Int. Cl.[3] ..... E04B 2/00

[52] U.S. Cl. ..... 156/71; 7/105; 52/746; 156/267; 156/308.8; 156/576; 156/579; 269/904; 294/165; 294/166

[58] Field of Search ..... 156/71, 576, 267, 579, 156/308.8; 52/746; 294/165, 166; 269/904; 7/105

[56] References Cited

U.S. PATENT DOCUMENTS

| | | | |
|---|---|---|---|
| 609,008 | 8/1898 | Carter | 156/576 |
| 746,099 | 12/1903 | Kerns et al. | 156/576 |
| 1,199,269 | 9/1916 | Hammersly | 156/576 |
| 1,270,530 | 6/1918 | Likins | 156/576 |
| 2,002,633 | 5/1935 | Greene | 156/576 |
| 2,347,865 | 5/1944 | Yates et al. | 156/71 |
| 4,209,865 | 7/1980 | Kozlowski | 7/105 |

*Primary Examiner*—John J. Gallagher
*Attorney, Agent, or Firm*—C. A. Phillips

[57] ABSTRACT

A method of hanging wallpaper wherein a wallpaper hanging tool is constructed to include a guide plate assembly having a pair of paper clamps on one side, and having an elongated edge as a guide edge over which paper is drawn and then clamped. The handle is centrally attached to the guide plate assembly, and paper held by the clamps is positioned at the ceiling edge of a wall, then cut at the ceiling edge and smoothed downward.

4 Claims, 6 Drawing Figures

METHOD OF HANGING WALLPAPER

TECHNICAL FIELD

This invention relates to an improved method for hanging wallpaper.

BACKGROUND OF THE INVENTION

It is believed that most will agree that hanging wallpaper is a chore which is not easy to master by the householder who elects to hang it himself. It involves handling a relatively long piece of sometimes flimsy paper material which must be wet on one side and then applied to a wall with the paper in a precise orientation.

It has long been recognized that some form of holding device is desirable, and a fairly recent suggestion of one is contained in U.S. Pat. No. 4,072,547. The device of this patent is T-shaped, and a sheet of paper to be hung is draped over a guide edge and drawn back a rather substantial distance and clamped by a clamp on the handle of the device. It is then used by making an initial contact at a point on the wall substantially down from the ceiling, and thereafter releasing the clamp holding the end of the paper and pushing upward on the device until the paper is brought up to the ceiling. Clearly, this device eases the problem of hanging paper when compared with hanging it without mechanical aid. However, there are still problems which are unsolved with this device.

First, since contact is made without reference to the ceiling, the precise point on a wall to make an initial contact to enable the paper on the device to just reach the ceiling is not easy. In doing this, the paper is first aligned at the bottom edge of a wall, a rather substantial distance below where the contact on the wall is to be made using the device. Thus, if as suggested in the patent the handle is between two and four feet long, then the user must be making a contact with the wall four to six feet above the reference bottom edge, a rather difficult feat.

In general, the attempt to employ the bottom edge as a reference and work upward, or possibly work upward and downward, is both unconventional and unwieldy. It is most difficult to use one edge as a reference and start smoothing from a different one, in this case, the mid point region. Further, in attempting to work from bottom to top, it becomes most essential that the paper be cut to a precise length, else either one is short at the top, or there may be an overage at the top. If the latter occurs when the device is moved away, the paper will tend to drape down and pull away from the wall.

Accordingly, it is the object of this invention to provide an improved paper hanging method which avoids the problems discussed and enables a downward smoothing of the paper from the very top of a wall to the bottom, permitting a more convenient application of wallpaper to a wall, and, accordingly, a more precise hanging of wallpaper with less expertise.

SUMMARY OF THE INVENTION

In accordance with this invention, a first wallpaper hanging device is constructed of a wallpaper guide and clamping assembly which is centrally attached to an elongated handle. The guide and clamping assembly is formed with a thin plate region which has a straight guide edge as an outer edge. On one side of the assembly there is a pair of spaced clamps for clamping paper. Paper to be hung is drawn over the guide edge and held in place by clamps proximate to the edge. Then, adhesive-backed paper is drawn through a water bath. Next, holding the handle in one hand, and moving the paper and guide edge up against a ceiling with one hand, a portion of the paper just under the device is pressed into adherence with a wall with the other hand. Then, still holding the paper by the device, and with the handle elevated to clearly expose the guide edge, the paper is cut along the guide edge and thereby the paper cut closely adjacent to the ceiling. Thereafter, the paper is smoothed downward, and finally, the lower edge of the paper cut where it strikes either moulding or the floor.

DETAILED DESCRIPTION OF THE DRAWINGS

Figure 2:
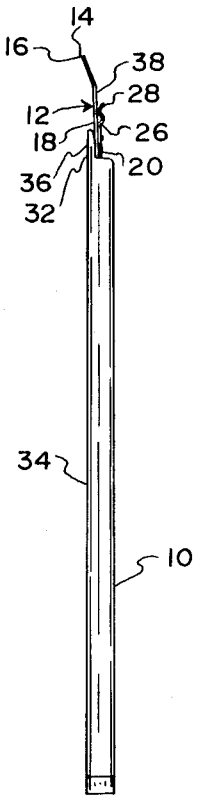
FIG. 2 is a side view of the device shown in FIG. 1.
Figure 1:
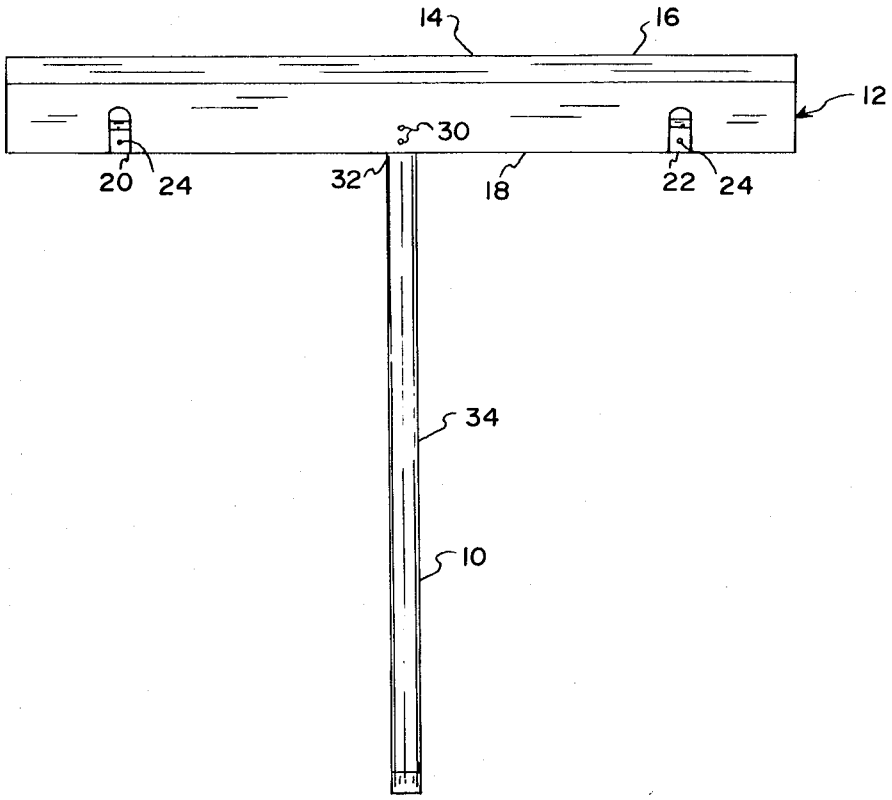
FIG. 1 is a top view of the device employed by my invention.

Referring to the drawings, and initially to FIGS. 1 and 2, showing wallpaper hanger 10, a guide plate assembly 12 is formed with a turned-in portion 14 which terminates at a guide edge 16. A main plate portion 18 of guide plate assembly 12 extends from the opposite side of the turned-in portion and lies in a plane 15° to 30° with respect to the plane of the turned-in portion. It, the main plate portion, supports a pair of paper clamps or clips 20 and 22 which are attached as by rivets 24 to main plate 18 on the side opposite to the direction of turned-in portion 14. These clamps are typically formed of spring steel, and each includes a turned-down spring region 26 and outer turned-up edge 28 whereby paper may be readily inserted and then clamped by turned-down region 26.

Main plate portion 18 is centrally attached via rivets or screws 30 to end portion 32 of handle 34, end portion 32 being formed of reduced cross section whereby guide plate assembly 12 may be readily attached closely adjacent to an edge surface 36 of handle 34, and thus guide edge 16 is displaced such that it would intersect a plane parallel to, but spaced from, a plane along surface 38. In this fashion, edge 16 extends to the side of surface 38, enabling convenient access to this edge when handle 34 is at a fairly small angle with respect to a wall. Guide plate assembly 12 is typically 26 inches in length and constructed of a relatively thin material, for example, turned-in portion 14 being particularly thin, e.g., being of a thickness of approximately 1/32 to 3/32 inch. Handle 34 is typically 20 to 30 inches in length, being of a length wherein a person can, with one hand, hold a cutting tool in engagement with guide edge 16 while holding handle 34, and thus device 10 have sufficient elevation to make guide edge 16 accessible. Handle 34 is typically constructed of lightweight material, such as aluminum or plastic, and of a convenient diameter for holding, for example, approximately ¾ inch.

Figure 3:
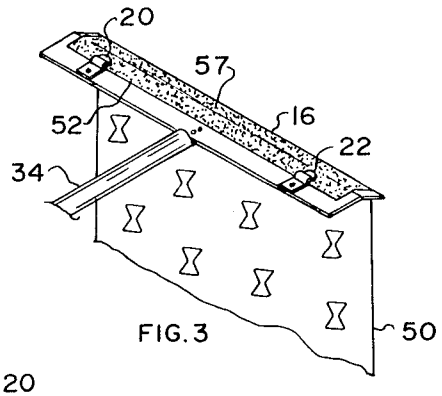
FIG. 3 is a pictorial view illustrating the positioning of wallpaper on the device.
Figure 4:
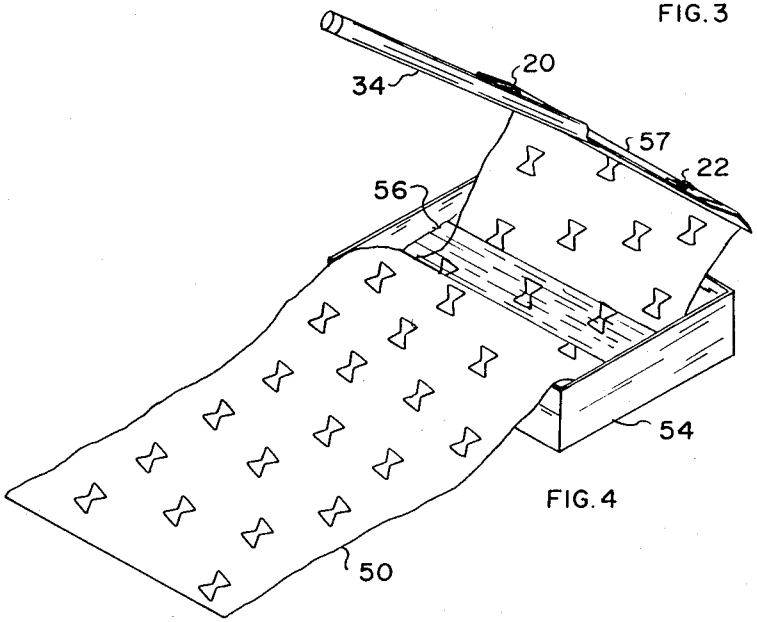
FIG. 4 is a pictorial view illustrating moving a strip of wallpaper through a solution to wet the paper preparatory to hanging it.

To hang paper in accordance with the present invention, and with reference to FIG. 3, a sheet of wallpaper 50, typically 20½ or 26 inches in width and six to eight inches longer than the wall height, is arranged with end 52 drawn over edge 16 and inserted under clamps 20 and 22 and thereby held in place as shown. Next, holding handle 34, and as shown in FIG. 4, wallpaper 50 is drawn through a container 54 having water 56 partially filling it, and in this way, wetting the glue on the underside 57 of wallpaper 50.

Figure 5:
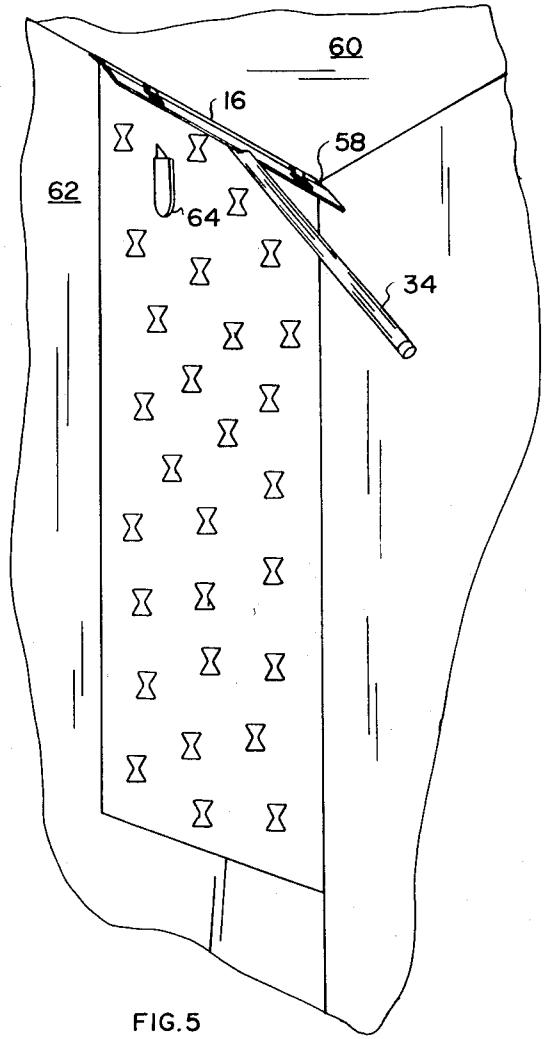
FIG. 5 is a pictorial view illustrating steps of the invention.

Next, as illustrated in FIG. 5, the wallpaper is lifted by raising handle 34 with one hand to a position where guide edge 16 is against the corner 58 where ceiling 60 and wall 62 meet. Then, with the other hand, a portion of the wallpaper in the vicinity of numeral 58 is smoothed in the upper region of the wallpaper to thus effect a gluing of this upper portion of the wallpaper to wall 62.

Thereafter, and with a cutting tool 64, the edge of the wallpaper just under and adjacent to guide edge 16 is cut along the guide edge and wallpaper hanger 10 removed. Next, in a conventional fashion, the wallpaper is smoothed downward to the top of moulding 66 (FIG. 6).

Figure 6:
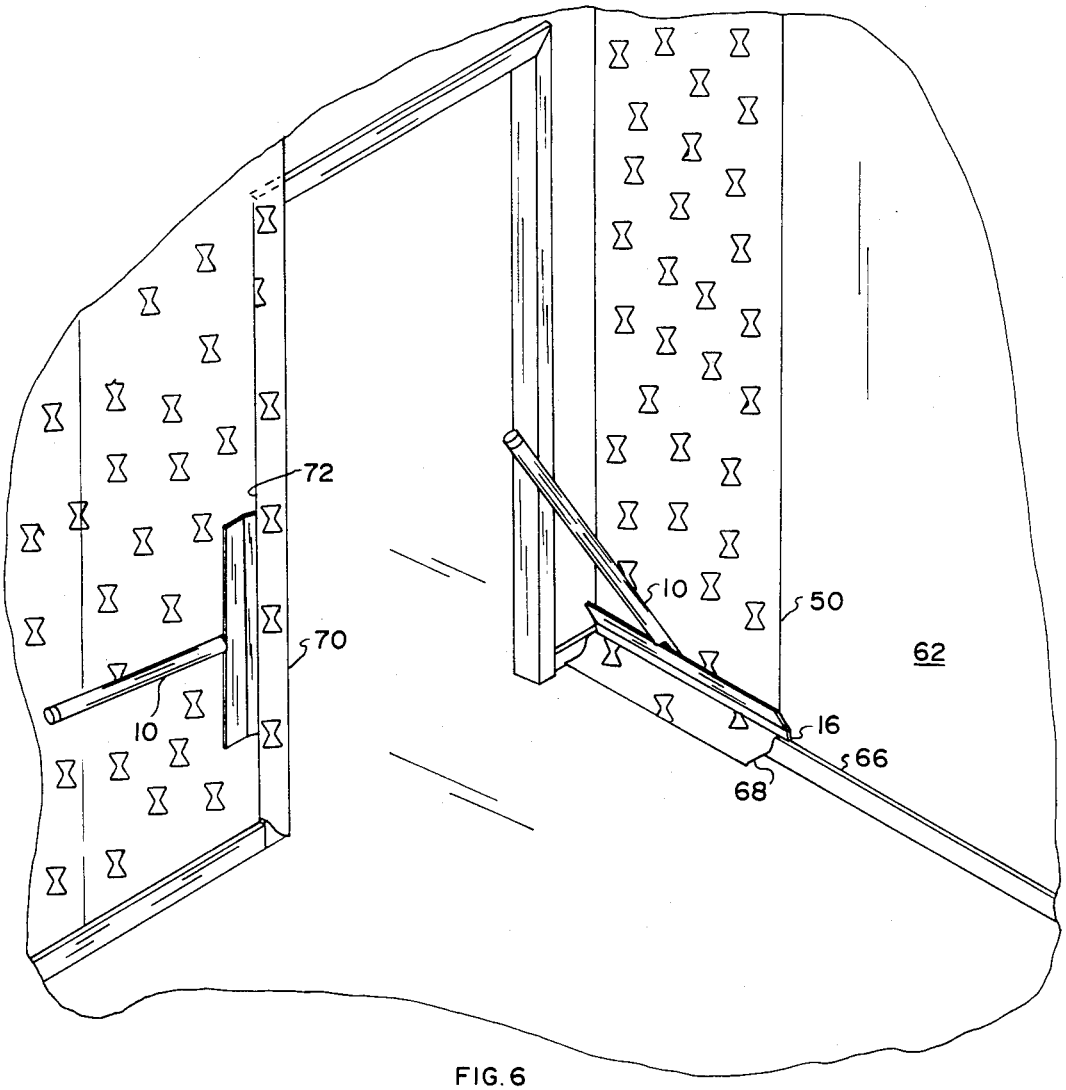
FIG. 6 is a perspective view illustrating further steps as contemplated by this invention.

Then, wallpaper hanger 10 is placed in the position shown in FIG. 6, with guide edge 16 holding wallpaper 50 against the intersecting line between moulding 66 and wall 62, and the paper is cut along the guide edge. The excess portion 68 is then discarded.

FIG. 6 also illustrates the employment of wallpaper hanger 10 to effect the position of the wallpaper closely against vertical moulding for cutting, such as against moulding 70. Thus, in such case, wallpaper hanger 10 would urge the paper against guide edge 72 of moulding 70, and thereafter a cutting tool would be used to cut along the guide edge to thus make a clean straight cut at the intersection of the wall and moulding 70.

I claim:

1. The method of hanging wallpaper comprising:

gripping the handle of a wallpaper hanging device, in turn comprising:

an elongated handle, and an elongated wallpaper guide centrally attached to and extending at right angles with respect to and longitudinally beyond an end of said handle, and said guide having a continuous extreme outer guide edge extending in a direction normal to the direction of extension of said elongated handle and in a plane spaced from and parallel to a plane which passes through the longitudinal axis of said handle, a pair of spaced clamping means symmetrically attached to said guide on either side of the attachment of said handle, and each said clamping means including means for selectively clamping and unclamping paper;

next, drawing one end region of a length of wallpaper over said guide edge and clamping said end region by said clamping means;

then, with the clamping means on the side of said guide away from a wall and a relative adhesive state between a wall and wallpaper, by movement of said handle, positioning the paper on a wall with said guide edge pressing the paper against a ceiling-/wall intersection;

next, holding said handle out from a wall, cutting the paper along the underside of said guide edge, thereby cutting the paper closely adjacent to the ceiling;

then, smoothing the paper downward; and finally, cutting the lower edge where the paper strikes the boundary of a moulding or floor.

2. A method as set forth in claim 1 wherein said wallpaper guide and said clamping means comprises:

a side-by-side first elongated plate region; and a second and parallel elongated plate region connected together and lying in planes displaced by 15° to 30°.

3. A method as set forth in claim 2 wherein said wallpaper has an adhesive undercoating, and, after clamping the end of said wallpaper, and while holding said handle, said wallpaper is drawn through water prior to being positioned on a wall.

4. A method as set forth in claim 3 wherein said handle is 20 to 30 inches in height.

* * * * *